US007728527B2

(12) United States Patent
Hsieh

(10) Patent No.: US 7,728,527 B2
(45) Date of Patent: Jun. 1, 2010

(54) ENERGY SAVING POWER SUPPLY CIRCUIT

(75) Inventor: Ming-Chih Hsieh, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 432 days.

(21) Appl. No.: 11/858,125

(22) Filed: Sep. 20, 2007

(65) Prior Publication Data

US 2008/0238331 A1 Oct. 2, 2008

(30) Foreign Application Priority Data

Mar. 30, 2007 (CN) ..... 2007 1 0200365

(51) Int. Cl.
*H05B 37/02* (2006.01)

(52) U.S. Cl. ..... 315/209 R; 315/225; 315/DIG. 7

(58) Field of Classification Search ..... 315/307, 315/291, DIG. 5, DIG. 7, 209 R, 225, 226
See application file for complete search history.

(56) References Cited

U.S. PATENT DOCUMENTS 4,172,981 A * 10/1979 Smith ..... 307/66
4,821,166 A 4/1989 Albach
7,279,853 B2 * 10/2007 Chong ..... 315/307

* cited by examiner

*Primary Examiner*—David Hung Vu
(74) *Attorney, Agent, or Firm*—Frank R. Niranjan

(57) ABSTRACT

A power supply circuit includes a power supply input for receiving power from a power supply, a power supply output for supplying power to a load, a voltage reference circuit, and a switch circuit. The voltage reference circuit is connected between the power supply input and the power supply output for regulating voltage of the power supply circuit. The switch circuit is connected to the voltage reference circuit and the power supply output. The voltage reference circuit supplies regulated voltage to the switch circuit. The switch circuit controls current between the power supply input and the power supply output to be changed alternately at a certain frequency, thereby changing power output to the load to save electricity.

15 Claims, 1 Drawing Sheet

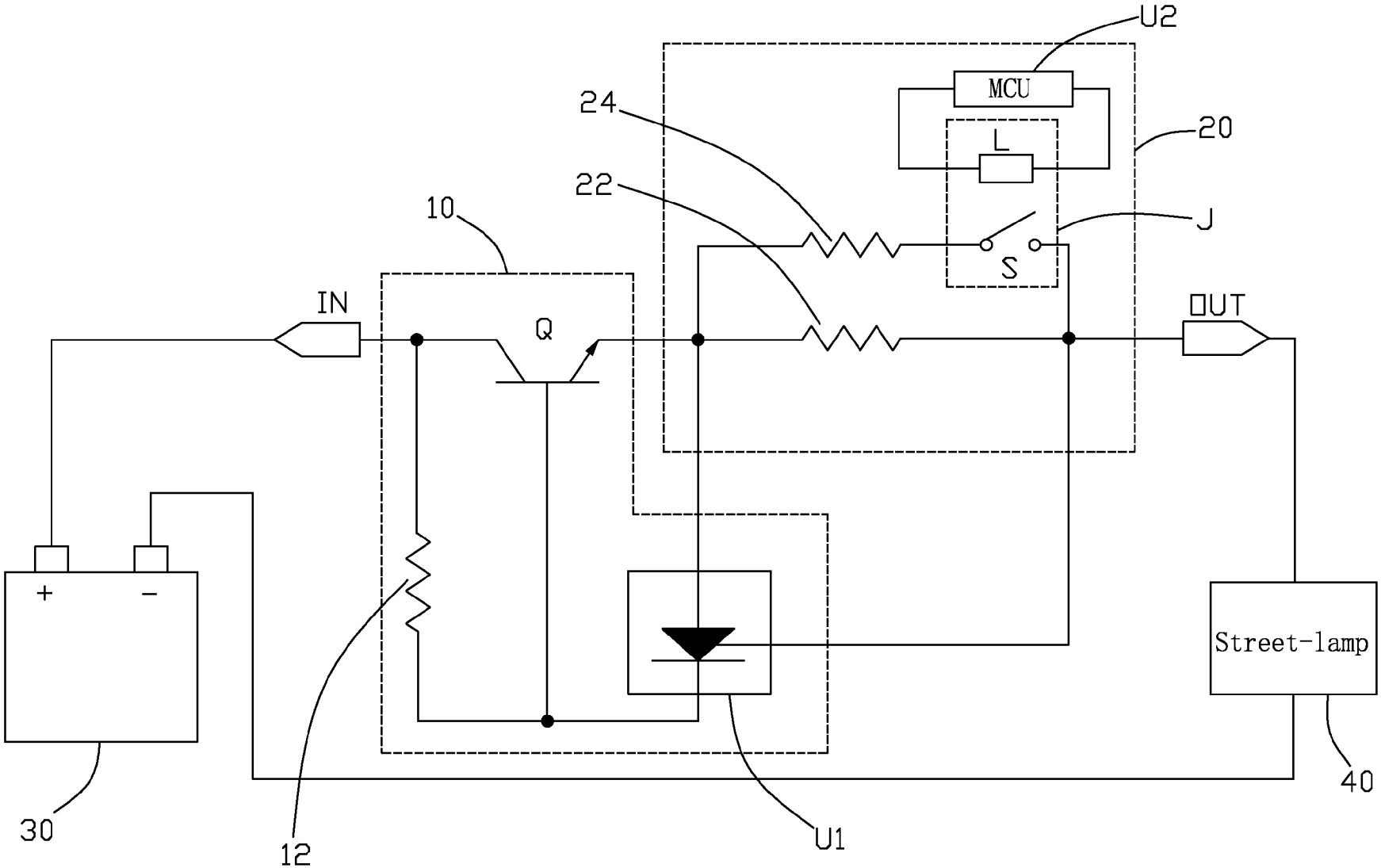
U2
20
MCU
L
J
S
24
22
OUT
Street-lamp
40
U1
Q
10
IN
12
-
+
30

ENERGY SAVING POWER SUPPLY CIRCUIT

BACKGROUND

1. Field of the Invention

The present invention relates to power supply circuits, and particularly to an energy saving power supply circuit.

2. Description of Related Art

Nowadays, with the earth's resources being depleted day by day, the cost of investment for energy increases significantly. Solar energy has drawn great attention from the energy industry as an alternative source of energy, and has found widespread applications in a variety of fields. For example, solar powered street-lamps are used in many countries.

A conventional solar powered street-lamp typically includes a solar energy operated absorption board, a storage battery, and a lamp. The solar energy operated absorption board absorbs solar energy and converts it into electric energy, which is used to recharge the storage battery. The storage battery supplies power to the lamp. However, the lamp typically works at a constant maximum power as supplied by the storage battery. Therefore, the lamp consumes energy quickly, so that the storage battery may not supply enough power to the lamp all night long.

What is desired, therefore, is to provide a power supply circuit which can effectively save electricity.

SUMMARY

An embodiment of a power supply circuit includes a power supply input for receiving power from a power supply, a power supply output for supplying power to a load, a voltage reference circuit, and a switch circuit. The voltage reference circuit is connected between the power supply input and the power supply output for regulating voltage of the power supply circuit. The switch circuit is connected to the voltage reference circuit and the power supply output. The voltage reference circuit supplies regulated voltage to the switch circuit. The switch circuit controls current between the power supply input and the power supply output to be changed alternately at a certain frequency, thereby changing power output to the load to save electricity.

Other advantages and novel features of the present invention will become more apparent from the following detailed description of an embodiment when taken in conjunction with the accompanying drawing, in which:

BRIEF DESCRIPTION OF THE DRAWING

The drawing is a circuit diagram of a power supply circuit in accordance with an embodiment of the present invention, together with a storage battery and a street-lamp.

DETAILED DESCRIPTION

Referring to the drawing, a power supply circuit in accordance with an embodiment of the present invention includes a power supply input IN, a voltage reference circuit 10, a switch circuit 20, and a power supply output OUT. The power supply input IN is configured for connecting to an anode of an external power supply, such as a storage battery 30. The power supply output OUT is configured for connecting to an anode of a load, such as a street-lamp 40. A cathode of the storage battery 30 is connected to a cathode of the street-lamp 40.

The voltage reference circuit 10 includes a first resistor 12, a transistor Q, and a voltage regulator U1. The power supply input IN is connected to a cathode of the voltage regulator U1 via the first resistor 12, and also connected to a collector of the transistor Q. A base of the transistor Q is connected to the cathode of the voltage regulator U1. An emitter of the transistor Q is connected to an anode of the voltage regulator U1. A reference terminal of the voltage regulator U1 is connected to the power supply output OUT. In this embodiment, the voltage regulator U1 is a TL431 programmable shunt regulator form Texas Instruments. The regulator U1 regulates the voltage of the power supply output OUT to a preset value.

The switch circuit 20 includes a second resistor 22, a third resistor 24, a relay J, and a micro control unit (MCU) U2. The relay J includes a coil L and a switch S controlled through the coil L. The second resistor 22 is connected between the emitter of the transistor Q and the power supply output OUT. The third resistor 24 is connected in series with the switch S, the third resistor 24 with the switch S is connected in parallel to the second resistor 22. The coil L has two opposite ends connected to two control pins of the MCU U2 respectively. The MCU U2 controls the switch S through the coil L. In other embodiments, the MCU U2 can be replaced by other programmable apparatuses.

According to Ohm's law, when the switch S is closed:

$$I1 = V\text{ref}/((R2*R3)/(R2+R3));$$

And when the switch S is open:

$$I2 = V\text{ref}/R2$$

Where, I1 is an input current of the street-lamp 40 when the switch S is closed, I2 is an input current of the street-lamp 40 when the switch S is open. Vref is a reference voltage of the voltage regulator U1. R2 is a resistance of the second resistor 22, and R3 is a resistance of the third resistor 24. In this embodiment, the input current I1 is a current when the street-lamp 40 is at a standard status, and the input current I2 is a current when the street-lamp 40 is at a low power status.

The MCU U2 controls the switch S alternately to be open and closed at a certain frequency, so that the input current of the street-lamp 40 is alternately the input current I1 and I2 at the frequency. Therefore, the street-lamp 40 alternately works in the standard status and low power status at the frequency. In this embodiment, the frequency is not less than 60 Hz, so that people won't notice the changing power states of the street-lamp 40.

The power supply circuit can control the street-lamp 40 to alternately work in the standard status and low power status at the certain frequency, instead of working at the standard status all the time. Thereby, the power supply circuit can effectively save electricity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power supply circuit comprising:

a power supply input for receiving power from a power supply;

a power supply output for supplying power to a lamp;

a voltage reference circuit connected between the power supply input and the power supply output for regulating voltage supplied to the lamp; and a switch circuit connected to the voltage reference circuit and the power supply output, the voltage reference circuit supplying regulated voltage to the switch circuit, the switch circuit controlling current between the power supply input and the power supply output to be changed alternately at a certain frequency, thereby changing power output to the lamp to save electricity.

2. The power supply circuit as claimed in claim 1, wherein the voltage reference circuit comprises a first resistor, a transistor, and a voltage regulator, the power supply input is connected to a cathode of the voltage regulator via the first resistor, and also connected to a collector of the transistor, a base of the transistor is connected to the cathode of the voltage regulator, an emitter of the transistor is connected to an anode of the voltage regulator and connected to the switch circuit, a reference terminal of the voltage regulator is connected to the power supply output.

3. The power supply circuit as claimed in claim 2, wherein the voltage regulator is a programmable shunt regulator.

4. The power supply circuit as claimed in claim 2, wherein the switch circuit comprises a second resistor, a third resistor, a relay, and a micro control unit (MCU), the relay includes a coil and a switch controlled through the coil, the second resistor is connected between the emitter of the transistor and the power supply output, the third resistor is connected in series with the switch, the third resistor with the switch is connected in parallel to the second resistor, two opposite ends of the coil are connected to two control pins of the MCU respectively, the MCU controls the switch alternately to be open and closed at the certain frequency, through the coil.

5. The power supply circuit as claimed in claim 1, wherein the frequency is not less than 60 Hz so that person's eyes will not feel twinkle of the lamp.

6. A power supply circuit comprising:

an input connected to a power supply to receive power;

an output connected to a load to supply power to the load;

a voltage reference circuit connected between the input and the output to regulate a voltage supplied to the load; and a resistor switching circuit connected between the input and the output to alternately switch current supplied to the load between two different values, via alternately switching in two resistors of different resistances to the resistor switching circuit, thereby the load works alternately in a full power state and a lower power state to save electricity.

7. The power supply circuit as claimed in claim 6, wherein the resistors are switched at a predetermined frequency.

8. The power supply circuit as claimed in claim 7, wherein the load is a lamp, and the frequency is not less than 60 Hz so that the switching of the load between the full power state and the lower power state is not discernable to human eyesight.

9. The power supply circuit as claimed in claim 6, wherein the voltage reference circuit has a first resistor, a transistor, and a voltage regulator, the input is connected to a cathode of the voltage regulator via the first resistor, and also connected to a collector of the transistor, a base of the transistor is connected to the cathode of the voltage regulator, an emitter of the transistor is connected to an anode of the voltage regulator and connected to the switch circuit, a reference terminal of the voltage regulator is connected to the output.

10. The power supply circuit as claimed in claim 9, wherein the voltage regulator is a programmable shunt regulator.

11. The power supply circuit as claimed in claim 9, wherein the resistor switching circuit comprises the two resistors, a relay, and a micro control unit (MCU), the relay is connected in series with one of the two resistors between the emitter of the transistor and the power supply output, the relay and said one of the two resistors are connected in parallel to the other one of the two resistors, the relay has a coil and a switch controlled through the coil, two opposite ends of the coil are connected to two control pins of the MCU respectively, the MCU controls the switch alternately to be open and closed through the coil.

12. A power supply circuit comprising:

an input connected to a power supply to receive a direct current therefrom;

an output connected to a lamp to provide a direct voltage to the lamp;

a voltage reference circuit connected between the input and the output to regulate the voltage supplied to the lamp; and a resistor switching circuit connected between the input and the output, the resistor switching circuit comprising at least two resistors connected in parallel between the input and the output, and a micro control unit (MCU) configured to alternately switch current supplied to the lamp between two different values, via alternately switching the effective resistance value of the at least two resistors between the input and the output such that the lamp works alternately in a standard status and a low power status to save electricity.

13. The power supply circuit as claimed in claim 12, wherein the resistor switching circuit further comprises a relay comprising a coil and a switch connected with one of the at least two resistors, and the MCU controls the switch alternately to be open and closed through the coil.

14. The power supply circuit as claimed in claim 12, wherein the power supply is a storage battery and the lamp is a light-emitting diode lamp.

15. The power supply circuit as claimed in claim 12, wherein the voltage reference circuit has a first resistor, a transistor, and a voltage regulator, the input is connected to a cathode of the voltage regulator via the first resistor, and also connected to a collector of the transistor, a base of the transistor is connected to the cathode of the voltage regulator, an emitter of the transistor is connected to an anode of the voltage regulator and connected to the switch circuit, a reference terminal of the voltage regulator is connected to the output.

* * * * *